US005617594A

United States Patent [19]

Chien

[11] Patent Number: 5,617,594

[45] Date of Patent: Apr. 8, 1997

[54] FOLDABLE CRADLE FRAME

[75] Inventor: Jui-lung Chien, Taichung, Taiwan

[73] Assignee: Jina Manufacturing Thai Co., Ltd., Thailand

[21] Appl. No.: 554,291

[22] Filed: Nov. 6, 1995

[51] Int. Cl.[6] ..... A47D 9/00

[52] U.S. Cl. ..... 5/102; 5/99.1; 5/108; 5/101

[58] Field of Search ..... 5/98.1, 98.3, 101, 5/102, 99.1, 655, 108

[56] References Cited

U.S. PATENT DOCUMENTS

| | | | |
|---|---|---|---|
| 2,133,561 | 10/1938 | Thornton-Norris | 5/98.3 |
| 2,425,195 | 8/1947 | Lenthall | 5/98.3 |
| 3,004,793 | 10/1961 | Loomis | 5/102 |
| 3,789,439 | 2/1974 | Berg et al. | 5/98.1 |
| 4,499,619 | 2/1985 | Kassai | 5/98.3 |
| 5,269,587 | 12/1993 | Cunningham et al. | 5/102 |

*Primary Examiner*—Steven N. Meyers
*Assistant Examiner*—Tuyet-Phuong Pham
*Attorney, Agent, or Firm*—Parkhurst, Wendel & Burr, L.L.P.

[57] ABSTRACT

A foldable cradle frame including a front foot, a rear foot, and an upper rod that are interconnected by common connecting bodies. The rear foot and the upper rod are pivotally connected to the connecting members and are rotatable through respective openings in the connecting members toward the front foot. Accordingly, the entire structure may be folded to provide a relatively compact structure. The rear foot is compressible along its axial length via an intermediate spring, to contribute to a rocking motion of the cradle. In addition, the cradle frame includes a U-shaped tubular member pivotally coupled to the front foot for receiving a portion of a cradle seat that is adapted to be fitted therewith.

10 Claims, 6 Drawing Sheets

FOLDABLE CRADLE FRAME

BACKGROUND OF THE INVENTION

The present invention relates to a foldable cradle, and particularly to a foldable cradle able to be collapsed to a very compact volume.

Various types of cradles have been used throughout history for babies to sleep in and are invaluable items in a bedroom or nursery. However, many cradles are inconveniently cumbersome and so there is a need for a lightweight cradle, particularly one which can be folded easily to a compact volume, thereby permitting it to be stored in a smaller space and also be transported conveniently.

A frame for a conventional cradle, as shown in FIG. 7 usually comprises a support rod 71, and an oblique base rod 72, distal ends 73 of the support rod 71 extending over respective distal tips of the oblique base rod 72, and a U-shaped rod 74 with a rocking motion generator 75 attached thereto is coupled to lower portions of the oblique base rod 72. However, this style of cradle cannot be easily assembled and dismantled resulting in an inconvenient volume when it needs to be stored or transported.

Thus, the present invention provides an improved cradle to mitigate or obviate the aforementioned problems.

SUMMARY OF THE INVENTION

It is an object of the present invention to provide a cradle which can be folded and slightly rocked and variable to positions wherein a baby can sleep and sit.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Turning to the drawings, it will seen that a foldable cradle comprises two connecting bodies 10, an upper rod 20, a rear foot 30 and a front foot 40.

Figure 2:
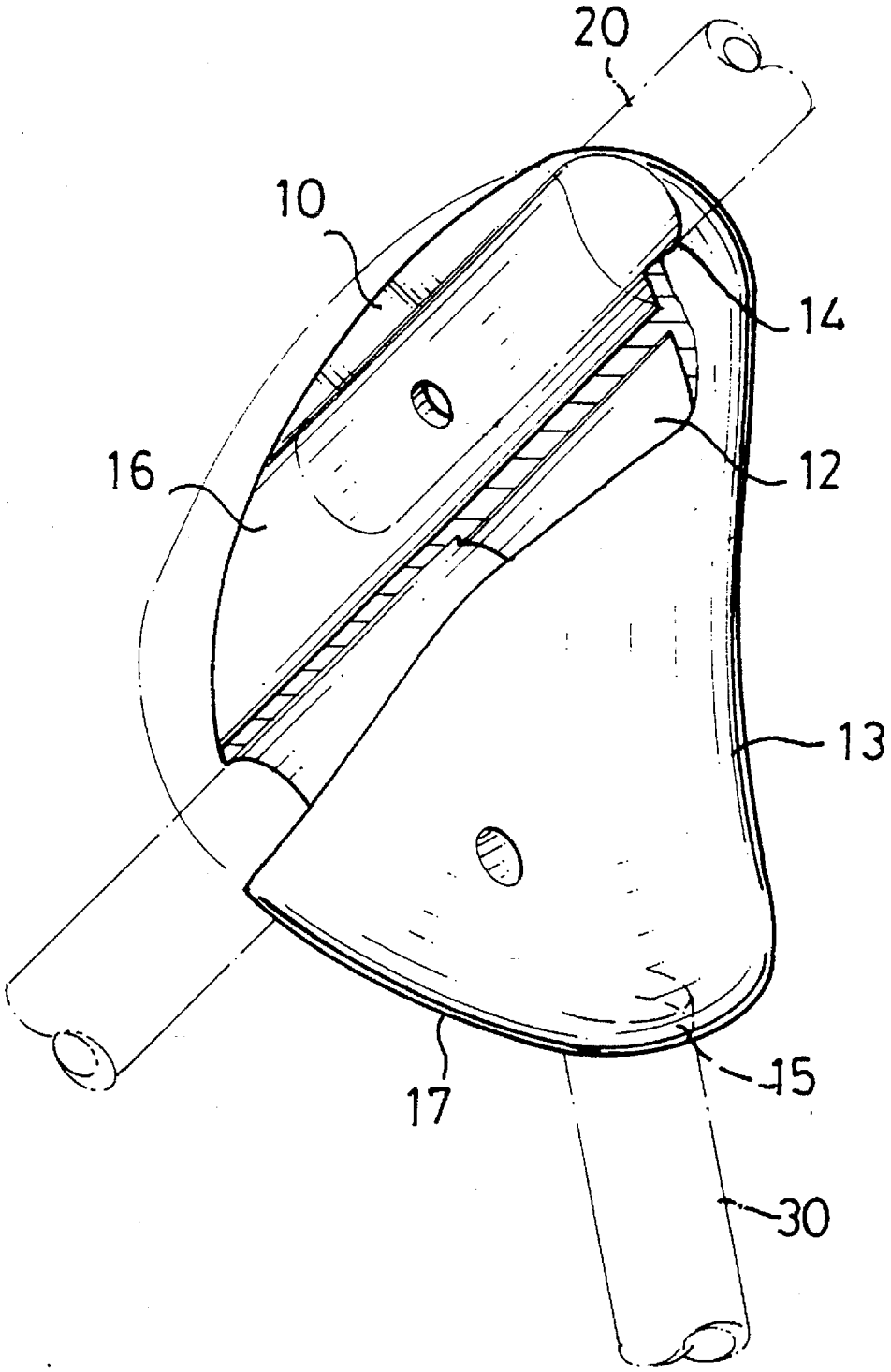
FIG. 2 is a partial cross-sectional view of a connecting body in accordance with the present invention.

As seen in FIG. 2, the connecting bodies 10 each have two sides and an angled slots 12 defined between two side walls. The connecting bodies 10 each have a back plate 13 formed at a back side thereof with respect to the slot 12 and an upper opening 16 defined at the upper side and adjacent to a top of the back plate 13 and a lower opening 17 defined at the lower side and adjacent to a bottom of the back plate 13. In addition, an upper recess 14 is defined at the top of the back plate 13 for receiving the upper rod 20 and a lower recess 15 is defined at a bottom of the back plate for accommodating the rear foot 30.

The upper rod 20 is substantially U-shaped in form and has two ends, each end being pivotable and rotatingly coupled to the upper opening 16 of the connecting body 10, the upper recess 14 providing a retaining effect when the upper rod 20 is in an unfolded mode.

The rear foot 30 consists of a first U-shaped rod 31 having a central portion and two perpendicular arms extending therefrom, a pair of second rods 32, a spring 33 being attached between free ends of the arms of the first rod 31 and each corresponding second rod 32 at a first end thereof and a sleeve 34 being disposed between a mediate portion of the arms of the first rod and a mediate portion of each second rod 32. A second end of each second rod 32 is pivotably and rotatingly coupled to the lower recess 15.

Figure 3:
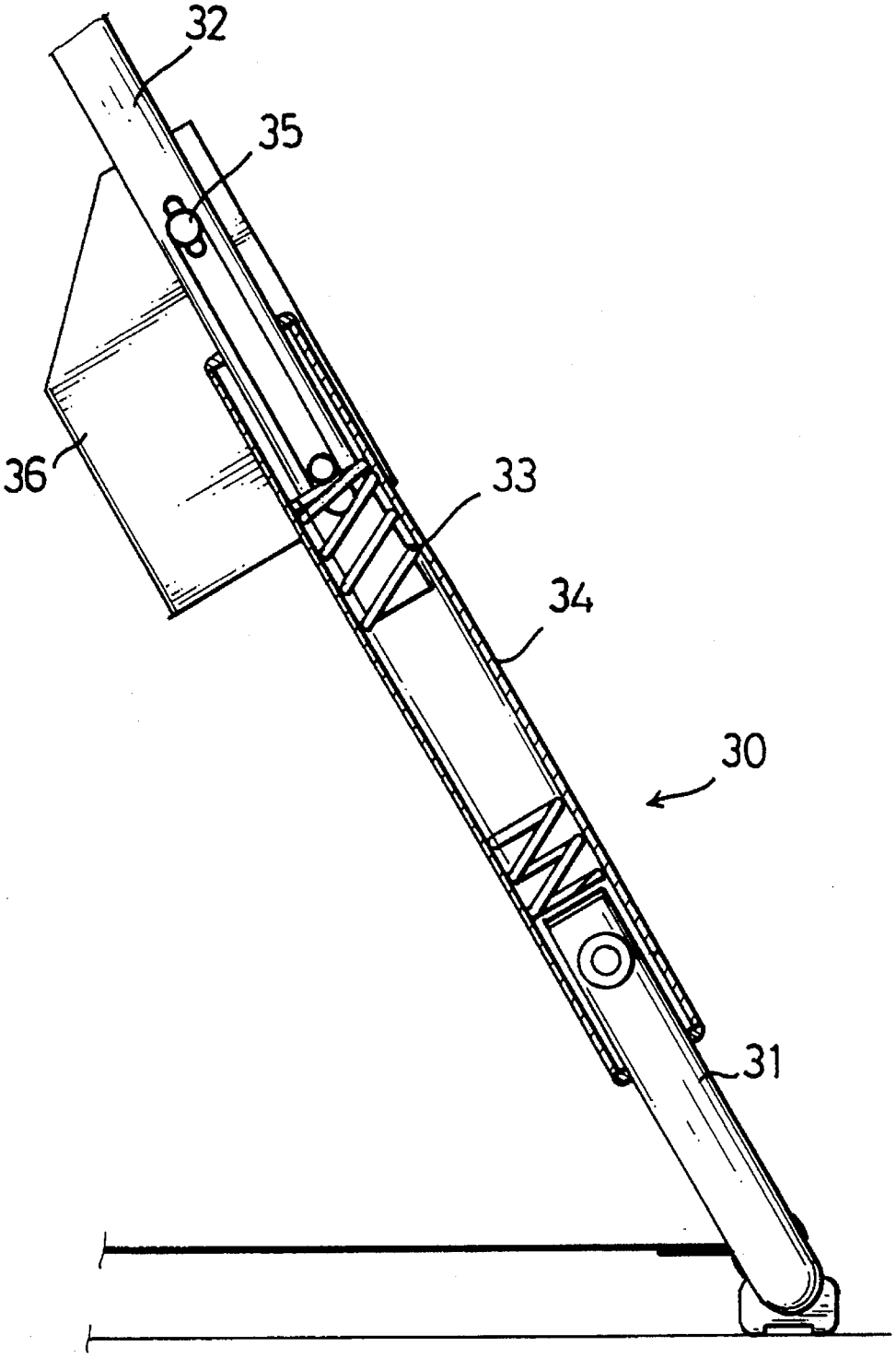
FIG. 3 is a fragmentary side view of a rear foot in accordance with the present invention.

A strut 35 extends between each second rod 32 at a point between the sleeve 34 and the connecting body 10. A rocking motion generator 36 with a switch 37 is disposed to the strut 35 for permitting movement of the first rod 31 with respect to the second rod 32 (FIG. 3).

Figure 1:
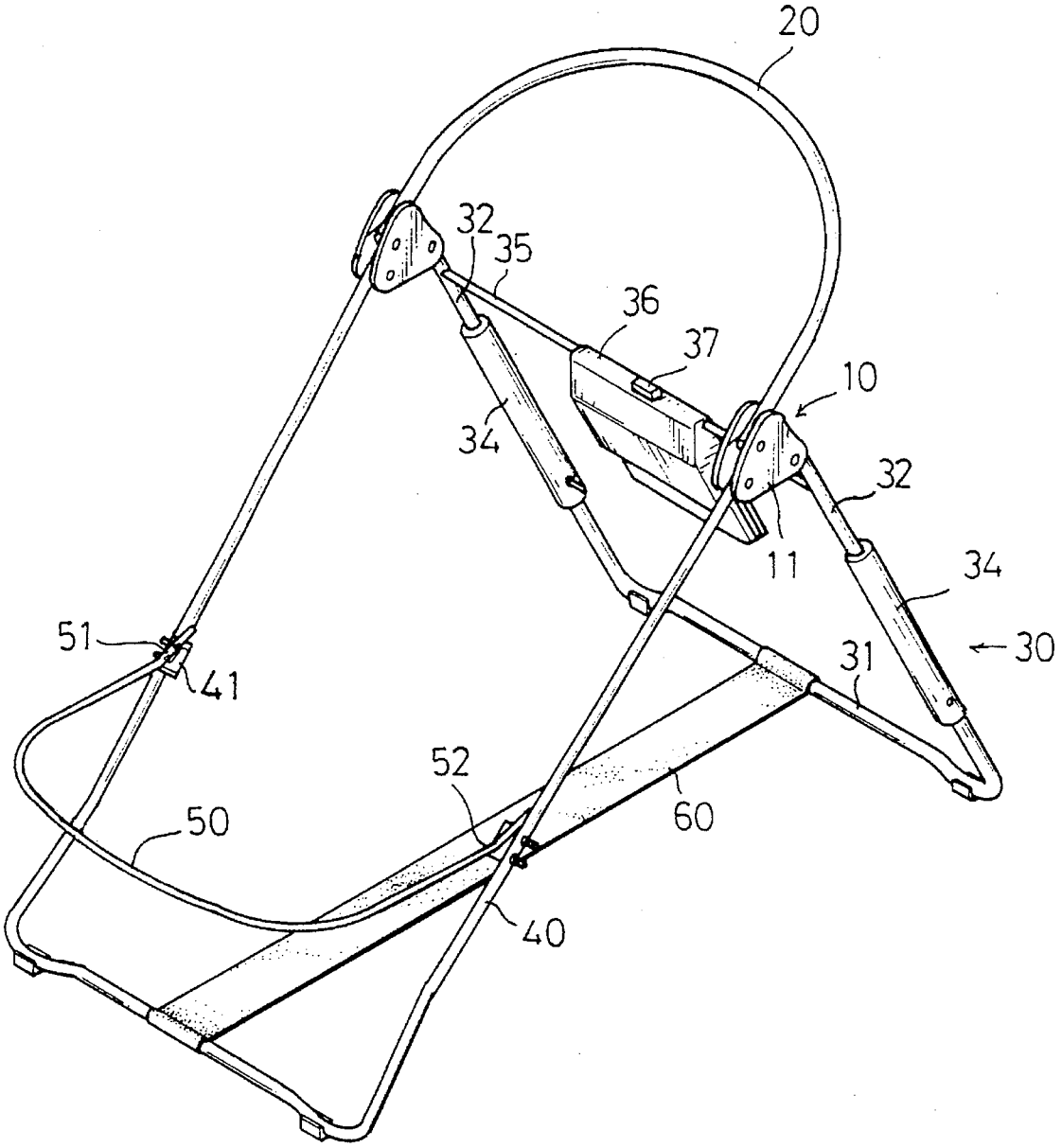
FIG. 1 is a perspective view of the foldable cradle in accordance with the present invention.

The front foot 40 is also substantially U-shaped in form, having a mid portion and two arms extending perpendicularly therefrom, each arm having a free end which is fixedly secured in the angled slot 12 of the corresponding connecting body 10. The cradle further comprises a tubular member 50 which is pivotably coupled to a middle portion of each arm of the front foot 40 and two mounting plates 41 being fixed to the respective arm of the front foot 40 adjacent to the tubular member 50. The tubular member 50 has two ends 51 fixedly located on the respective mounting plate 41 and each of the two ends 51 each extends forwardly and obliquely to form an angled portion 52 for adjusting the inclination of the tubular member 50. (FIG. 1)

The cradle further comprises a flexible strap 60 to limit the rear foot 30 to move with respect to the front foot 40 when the cradle is in an unfolded position.

Figure 4:
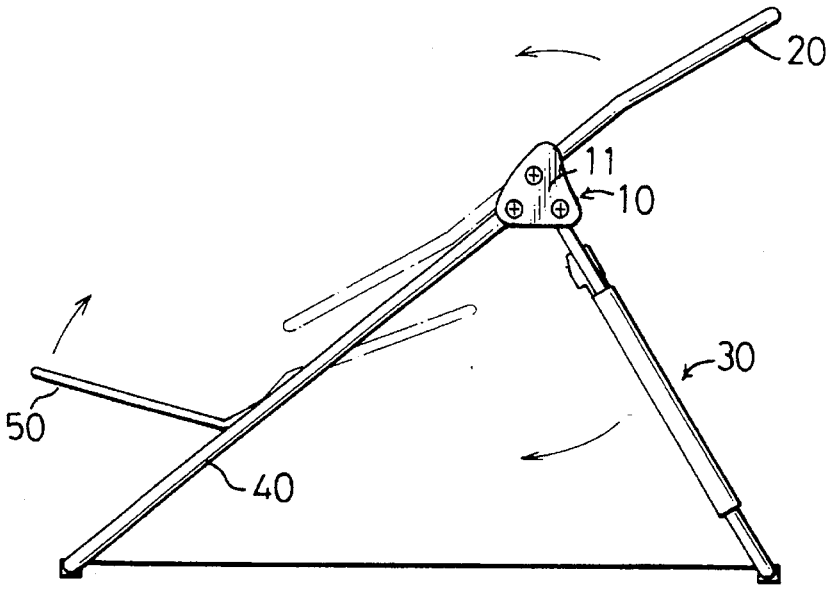
FIG. 4 is a side view showing the cradle of the present invention, in an erected configuration.
Figure 5:
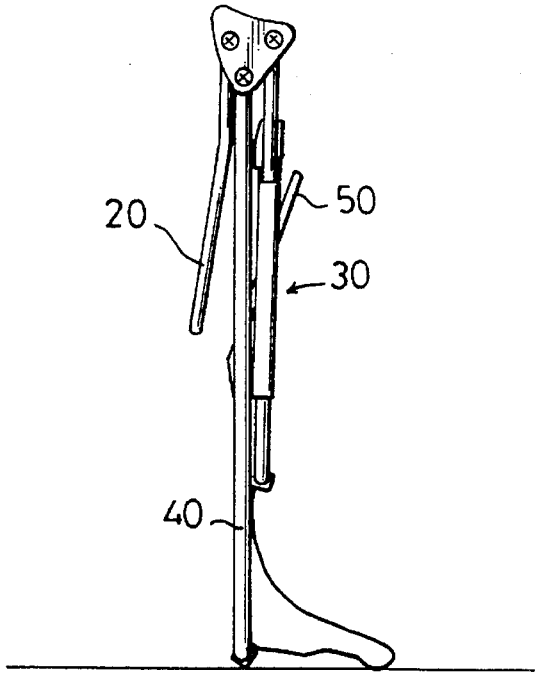
FIG. 5 is a side view showing the cradle of the present invention, in a closed configuration.

Turning now to FIGS. 4 and 5, it will be seen that the cradle can be released and folded from its use position shown in FIG. 4 to its storage position shown in FIG. 5. This folding operation involves moving the upper rod 20 counterclockwise to the front foot 40 and moving the rear foot 30 and the tubular member 50 clockwise to the front foot 40, whereby the folding the cradle is achieved.

Figure 6:
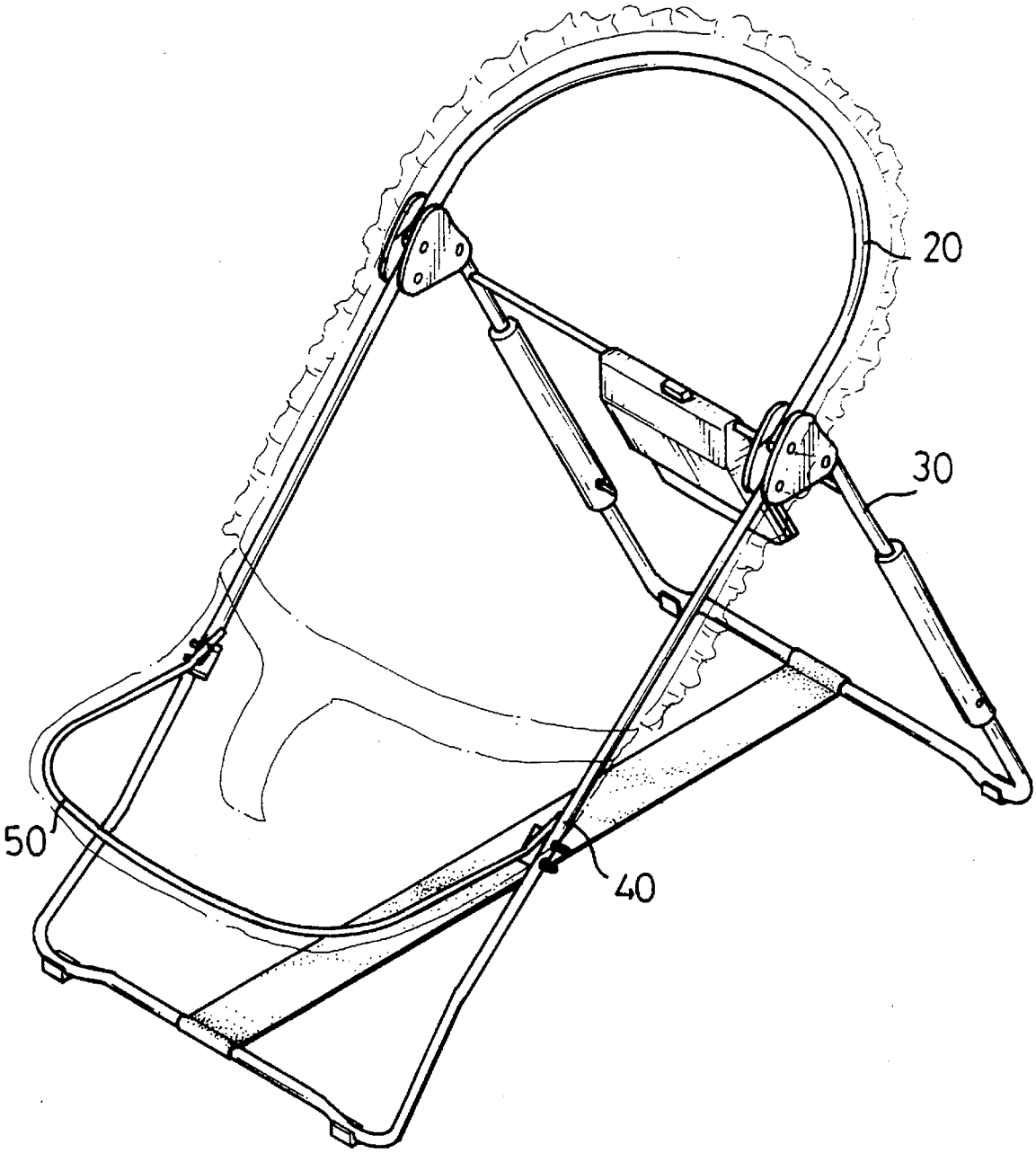
FIG. 6 is a side view showing an embodiment of the present invention, in an erected configuration.
Figure 7:
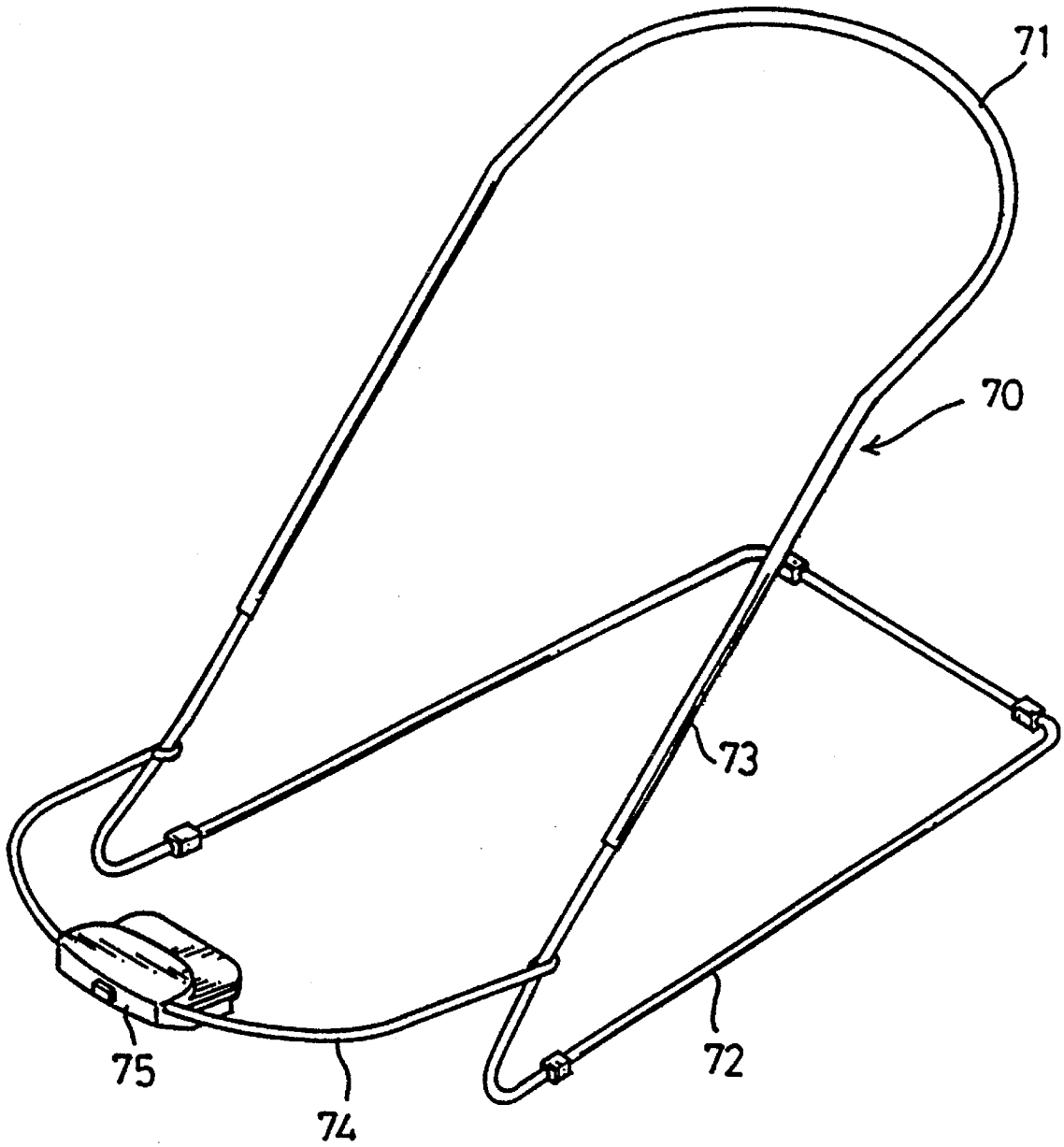
PRIOR ART FIG.7
FIG. 7 is a perspective view showing a conventional cradle.

As shown in FIG. 6, a seat (in phantom lines) is provided between the rod 20, the tubular member 50 and the front foot 40 for the baby's seating and sleeping. In addition, the second rods 32 of the rear foot 30 can be vibrated up and down by means of the rocking motion generator 36 to make the baby more comfortable when sleeping thereon.

Although the invention has been explained in relation to its preferred embodiment, it is to be understood that many other possible modifications and variations can be made without departing from the spirit and scope of the invention as hereinafter claimed.

What is claimed is:

1. A foldable cradle frame, comprising:

first and second connecting bodies each comprising two side walls connected together, one side wall forming a back plate, an upper opening and a lower opening extending between the side walls along upper and lower portions thereof, and an angled slot extending between the side walls and through the lower opening;

a front foot having first and second ends respectively secured in the slots of the first and second connecting bodies;

a rear foot comprising a first rod having opposing free ends, first and second connecting rods respectively attached to opposing free ends of the first rod via first and second sleeves, first and second springs respectively disposed in the first and second sleeves, each spring extending between a respective free end of the first rod and one of the first and second connecting rods, the first and second connecting rods extending through respective lower openings of the first and second connecting bodies and being respectively pivotally secured to the first and second connecting bodies, said rear foot being rotatable through the lower opening towards said front foot; and an upper rod pivotally connected to each of the connecting members so as to be rotatable through the respective upper openings towards the front foot.

2. The foldable cradle frame of claim 1, further comprising a strut extending between the first and second connecting rods.

3. The foldable cradle frame of claim 2, further comprising a rocking motion generator connected to the strut for generating movement of the connecting rods with respect to the first rod.

4. The foldable cradle frame of claim 1, wherein said upper opening of each connecting body terminates along an upper recess for receiving the upper rod in an unfolded position.

5. The foldable cradle frame of claim 1, wherein said lower opening of each connecting body terminates along a lower recess for receiving each connecting rod of the rear foot in an unfolded position.

6. The foldable cradle frame of claim 1, further comprising a flexible strap connecting the front and rear feet together, to limit movement of the rear foot with respect to the front foot.

7. The foldable cradle of claim 1, wherein said front foot is pivotally secured to the connecting bodies.

8. A foldable cradle frame, comprising:

first and second connecting bodies each comprising two side walls connected together, an upper opening and a lower opening extending between the side walls along upper and lower portions thereof, and an angled slot extending between the side walls and through the lower opening;

a front foot having first and second ends respectively secured in the slots of the first and second connecting bodies;

a rear foot having first and second ends respectively extending through the lower openings of the first and second connecting bodies and being pivotally secured thereto, such that the rear foot is rotatable through the lower openings towards the front foot;

an upper rod pivotally connected to each of the connecting members so as to be rotatable through the respective upper openings and towards the front foot;

a U-shaped tubular member pivotally coupled to the front foot; and first and second mounting plates secured to the front foot adjacent to the tubular member.

9. The foldable cradle frame of claim 8, wherein said U-shaped tubular member has first and second angled end portions for respectively abutting the first and second mounting plates.

10. The foldable cradle of claim 8, wherein said front foot is pivotally secured to the connecting bodies.

* * * * *